US006622533B1

(12) United States Patent
Santini

(10) Patent No.: US 6,622,533 B1
(45) Date of Patent: Sep. 23, 2003

(54) PROTECTIVE ENCLOSURE FOR A DOOR HANDLE RETAINING ASSEMBLY

(76) Inventor: Jerre Dennis Santini, 1412 Ethridge, Austin, TX (US) 78703

( * ) Notice: Subject to any disclaimer, the term of this patent is extended or adjusted under 35 U.S.C. 154(b) by 17 days.

(21) Appl. No.: 09/921,404

(22) Filed: Aug. 2, 2001

(51) Int. Cl.[7] ..... E05B 67/38

(52) U.S. Cl. ..... 70/56; 70/54; 70/417; 292/DIG. 32; 292/282

(58) Field of Search ..... 70/54–56, 417, 70/202, 211, 212, 203; 292/282, 285, 286, 287, DIG. 32, 54, 2, 218, 327

(56) References Cited

U.S. PATENT DOCUMENTS 4,122,693 A * 10/1978 Barr ..... 70/56
4,294,088 A * 10/1981 Barr ..... 70/56
4,742,701 A * 5/1988 Scavetto ..... 70/54 X
4,895,007 A * 1/1990 Eberly ..... 70/54
4,898,008 A * 2/1990 Eberly ..... 70/56
5,035,127 A * 7/1991 Larsen ..... 70/56
5,118,149 A * 6/1992 Emmons ..... 292/327
5,168,258 A * 12/1992 Radke ..... 70/54 X
5,737,946 A * 4/1998 Sole et al. ..... 70/54
5,743,118 A * 4/1998 Anderson ..... 70/56
5,878,604 A * 3/1999 Stone et al. ..... 70/56
5,975,595 A * 11/1999 Lorenzo ..... 70/56 X
6,009,731 A * 1/2000 Emmons et al. ..... 70/56
6,010,166 A * 1/2000 Hamilton et al. ..... 292/282
6,065,314 A * 5/2000 Nicholson ..... 70/56

* cited by examiner

*Primary Examiner*—Suzanne Dino Barrett
(74) *Attorney, Agent, or Firm*—Raymond M. Galasso; Simon, Galasso & Frantz PLC

(57) ABSTRACT

A protective enclosure according to one embodiment of the disclosures herein includes a hollow body and a lock capturing member attached tot he hollow body. The hollow body includes spaced apart side walls, a front wall attached between the spaced apart side walls and a first handle-engaging member at least partially defining a rear wall. The first handle-engaging member extends from a top end of the hollow body toward a bottom end of the hollow body. The first handle-engaging member is offset from a rear edge of each one of the side walls wherein a handle-receiving channel is defined between the side walls and the first handle-engaging member. The lock-capturing member is attached to the hollow body and includes a shank-receiving aperture for receiving a shank of a lock therethrough. The shank-receiving aperture is positioned within the hollow body.

23 Claims, 11 Drawing Sheets

PROTECTIVE ENCLOSURE FOR A DOOR HANDLE RETAINING ASSEMBLY

FIELD OF THE DISCLOSURE

The disclosures herein relate generally to protective enclosures and more particularly to a protective enclosure for a door handle retaining assembly.

BACKGROUND OF THE DISCLOSURE

Storage units such as trailers, portable buildings, sheds and the like are often left unattended at remote locations or locations that are not heavily traveled. Furthermore, such storage units often contain costly items that are easily transported. Accordingly, many storage units are desirable and accessible targets for burglary.

A storage unit generally includes a door latching apparatus for securing one or more doors in a closed position when the door latching apparatus is in a latched position. To prevent entry into the storage unit through the one or more doors, the door latching apparatus generally includes a locking device for enabling a door latching handle to be secured in a door latching position. One common locking device includes a handle retaining assembly capable of retaining the door latching handle in the door latching position and capable of having a lock attached thereto for locking the door latching apparatus in the door latching position.

The use of a lock for locking the door latching apparatus in the door latching position is a deterrent against burglary. However, for the determined thief, the lock and the handle retaining assembly are common points for being defeated to gain unauthorized access to the storage unit through the one or more doors. A thief will often gain unauthorized entry into the storage unit through the one or more doors by suitably cutting the handle retaining assembly of door latching apparatus or by cutting a shank of the lock attached to the handle retaining assembly with a bolt cutter, saw or other capable device.

Therefore a protective enclosure that limits access to a handle retaining assembly of a door latching apparatus and a lock attached to the handle retaining assembly is useful to preventing unauthorized entry into a storage unit through.

DETAILED DESCRIPTION

Figure 1:
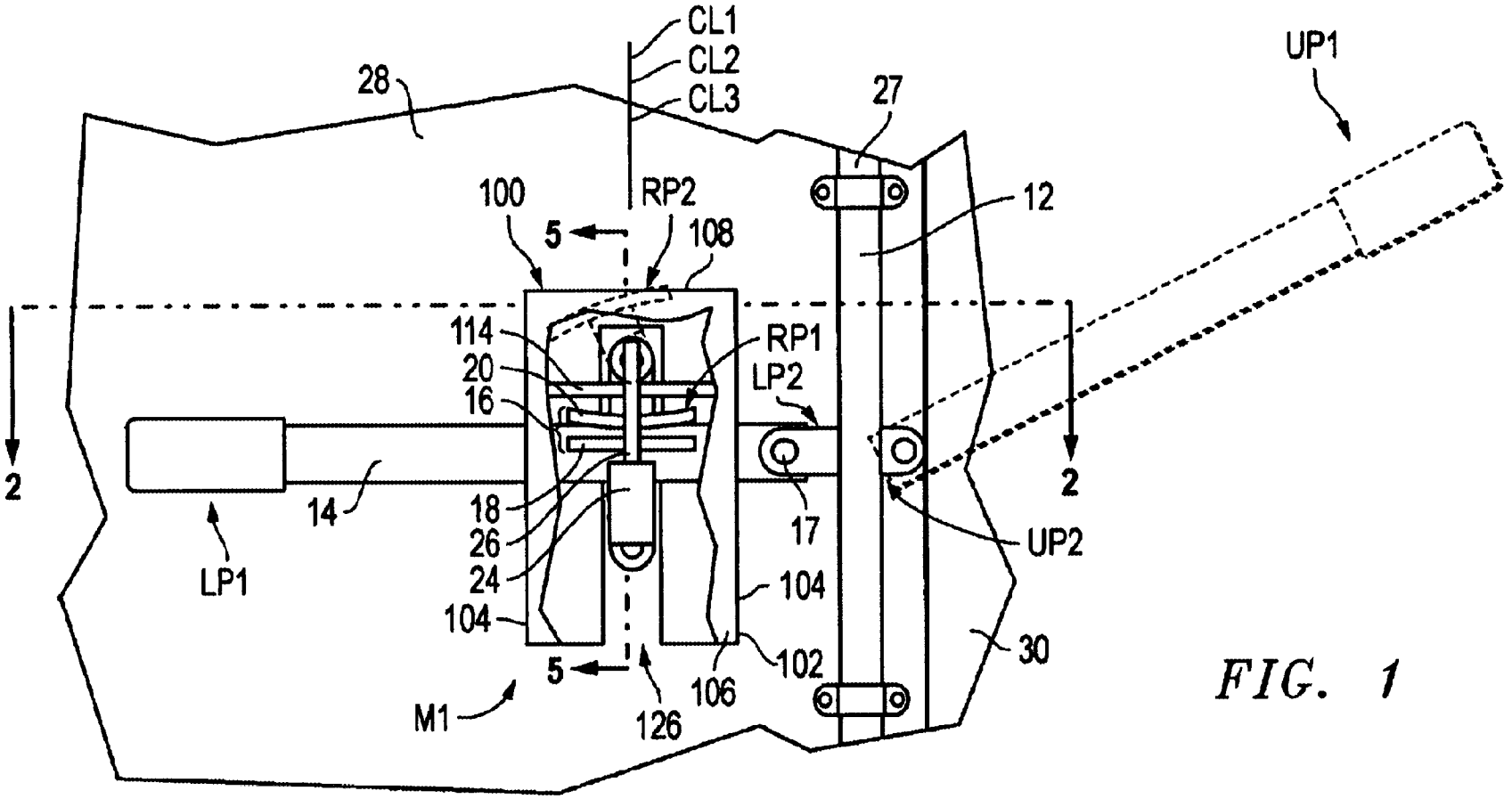
FIG. 1 is a front view depicting protective enclosure in accordance with a first embodiment of the disclosures made herein, wherein the protective enclosure is mounted on a first dual door arrangement of a storage unit.

FIGS. 1 through 20 depict protective enclosures according to various embodiments of the disclosures made herein. Such protective enclosures aid in preventing burglary of a storage unit such as a trailer, portable building and shed. The designs and constructions of such protective enclosures effectively limit the use of cutting devices for defeating door latching and locking components in an effort to gain unauthorized access to a storage unit through secured doors of the storage unit. Specifically, such protective enclosures limit the ability for a handle retaining assembly of a door latching apparatus or a shack of a lock attached to the handle retaining assembly to be cut a bolt cutter, saw or other capable device.

An embodiment of a conventional door latching apparatus capable of latching one door or a pair of doors is depicted in FIGS. 1 through 5. The door latching apparatus includes an elongated door latching member 12, a door latching handle 14 and a handle retaining assembly 16. The door latching handle 14 is movable between a door latching position LP1 and a door unlatching position UP1.

The door latching handle 14 is pivotally attached to the elongated door latching member 12 at a pivot point 17, thus allowing the door latching handle to be moved between the door latching position LP1 and the door unlatching position UP1. In response to moving the door latching handle 14 from the door latching position LP1 to the door unlatching position UP1, the door latching member 12 is Moved (e.g.

rotated) from a latching position LP2 to an unlatched position UP2. The door latching member 12 includes an elongated rod (generally shown herein as door latching member 12) and latching members (not shown) such as pawls attached at opposing ends of the elongated rod. The latching members are capable of engaging mating members (not shown) such as pockets mounted on a door frame when the door latching member 12 is in the door latching position LP2.

The handle retaining assembly 16 includes a stationary flange 18 and a movable flange 20 capable of retaining the door latching handle 14 in the door latching position LP1. The movable flange 20 is movable between a handle retaining position RP1 and a handle releasing position RP2. The stationary flange 18 and the movable flange 20 each include a shank-receiving aperture 22, FIG. 5. The shank receiving apertures 22 of the stationary flange 18 and the movable flange 20 are positioned on a centerline CL1 of the handle retaining assembly 16.

When the movable flange 20 is in a handle retaining position RP1, the shank-receiving aperture 22 of the stationary flange 18 is essentially aligned with the shank-receiving aperture 22 of the movable flange 20. Accordingly, when the movable flange 20 is in the handle retaining position RP1, a lock 24 may be mounted on the handle retaining assembly 16 for locking the door latching handle 14 to prevent movement from the door latching position LP1 to the door unlatching position UP1. The lock 24 is mounted on the handle retaining assembly 16 with a shank 26 of the lock 24 extending through the shank-receiving apertures 22 of the stationary flange 18 and the movable flange 20.

Figure 2:
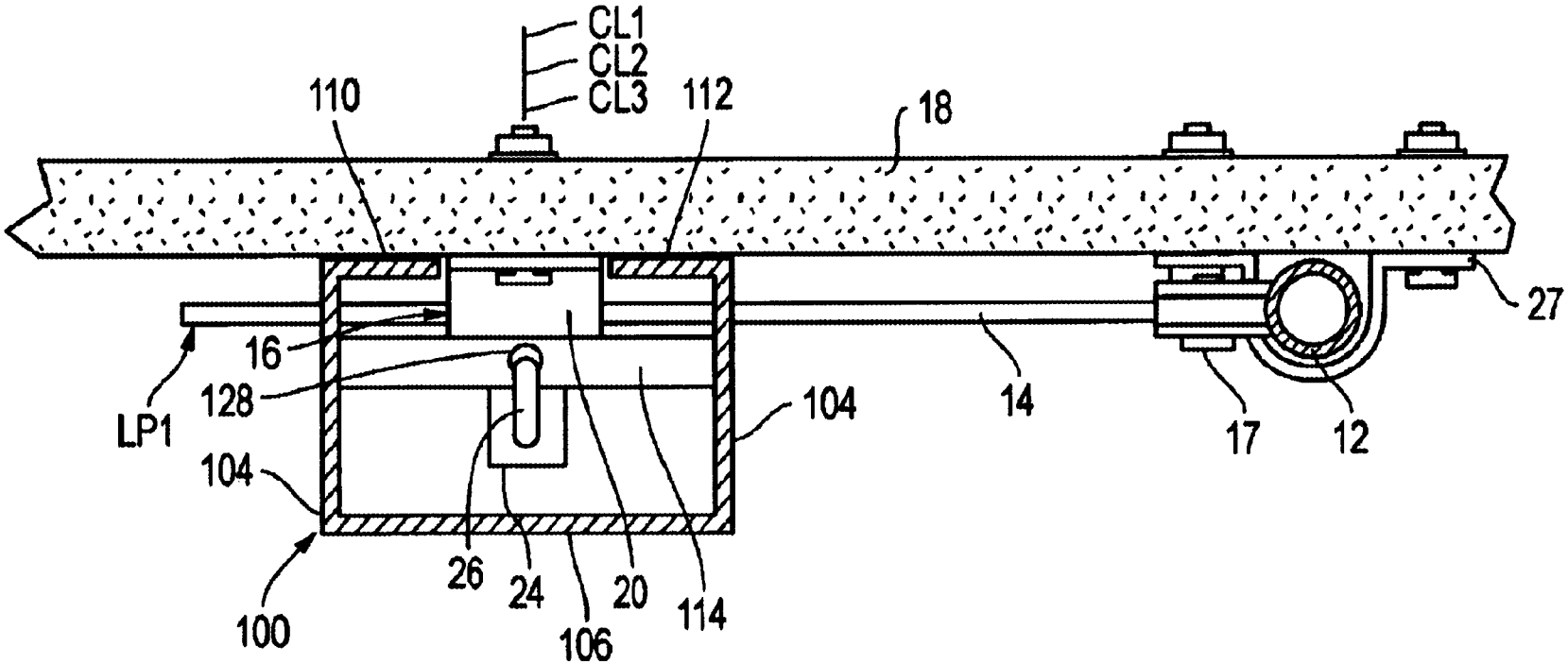
FIG. 2 is a cross-sectional view taken along the line 2—2 in FIG. 1.
Figure 3:
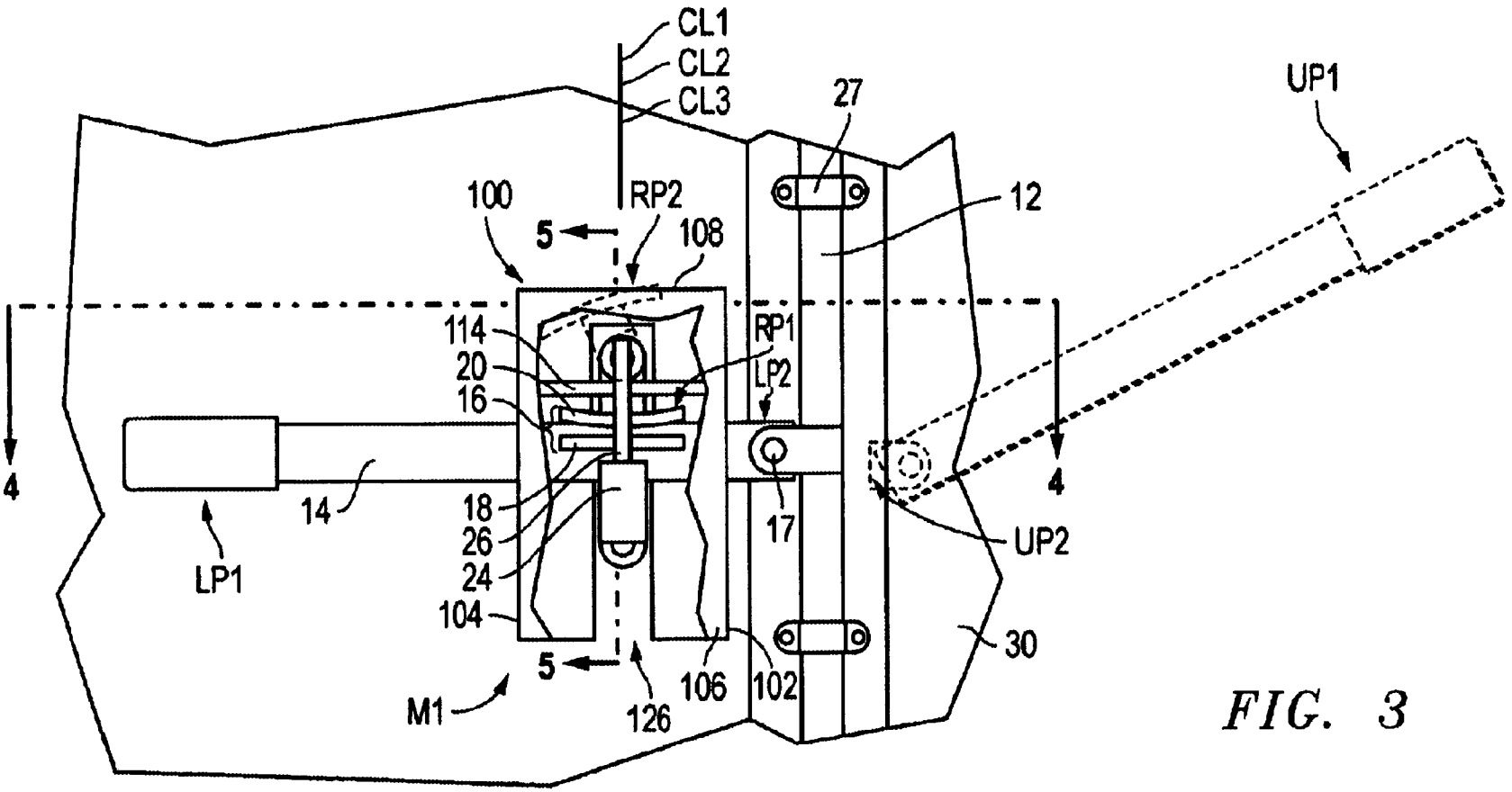
FIG. 3 is a front view depicting protective enclosure depicted in FIG. 1 mounted on a second dual door arrangement of a storage unit.
Figure 4:
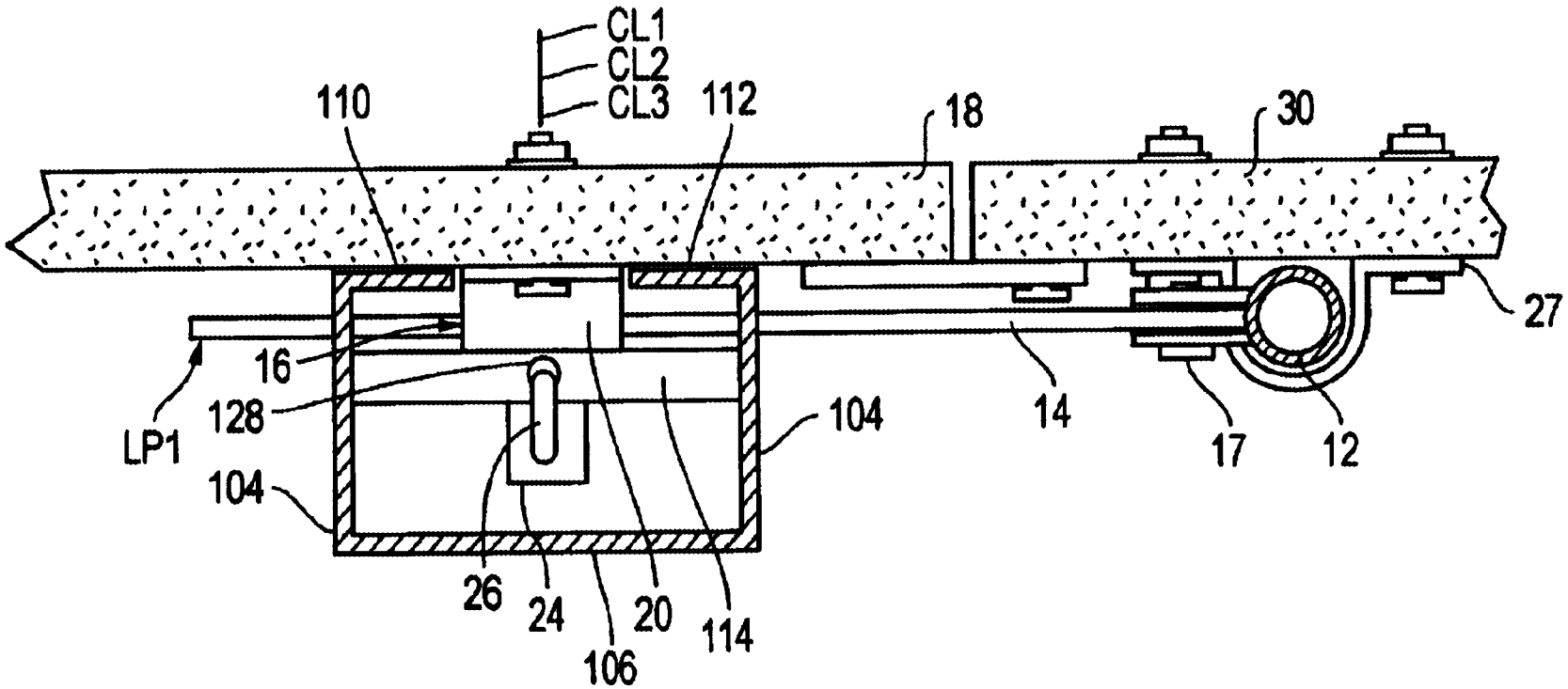
FIG. 4 is a cross-sectional view taken along the line 4—4 in FIG. 4.
Figure 5:
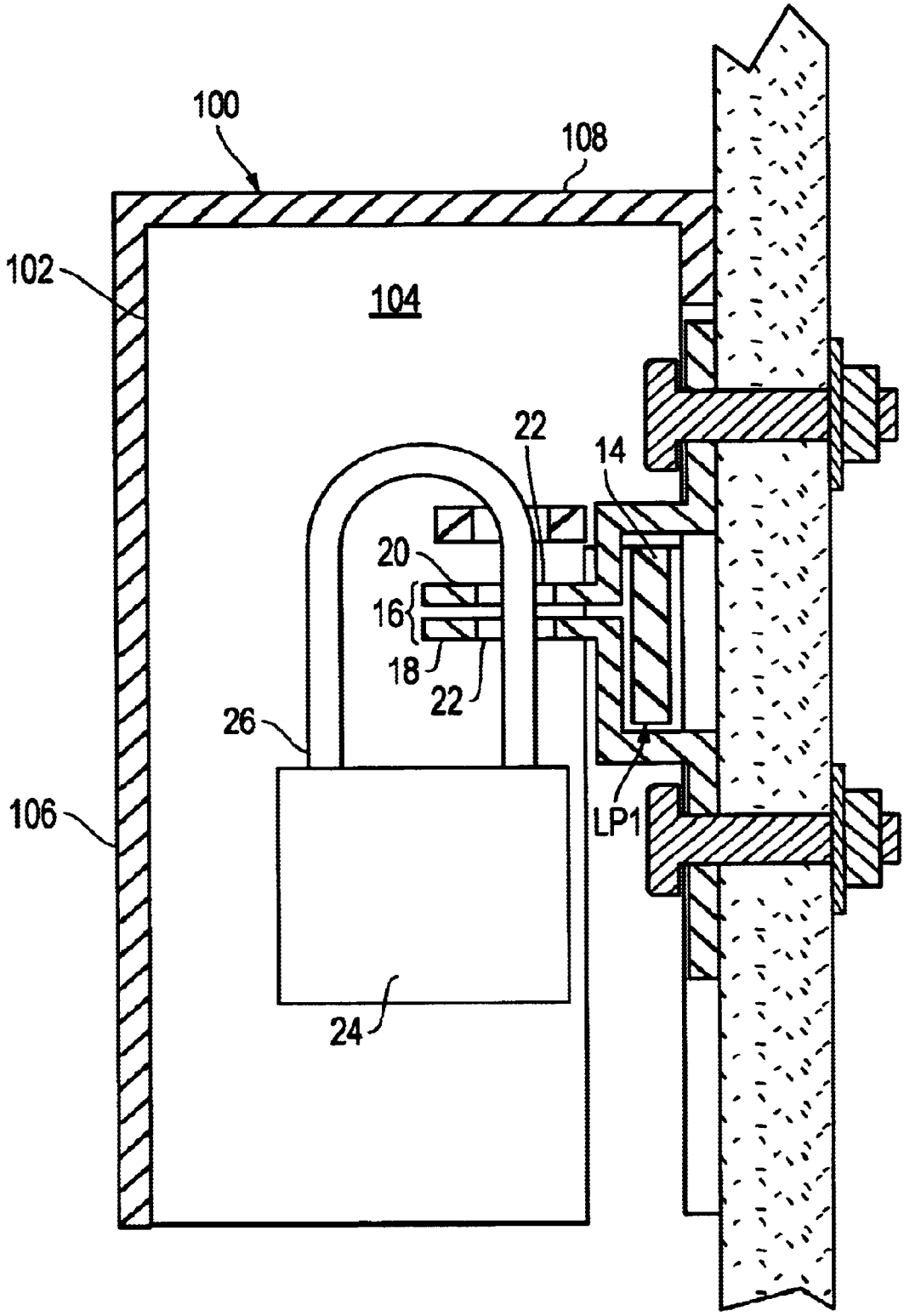
FIG. 5 is a cross-sectional view taken along the line 5—5 in FIGS. 1 and along the line 5—5 in FIG. 3.
Figure 6:
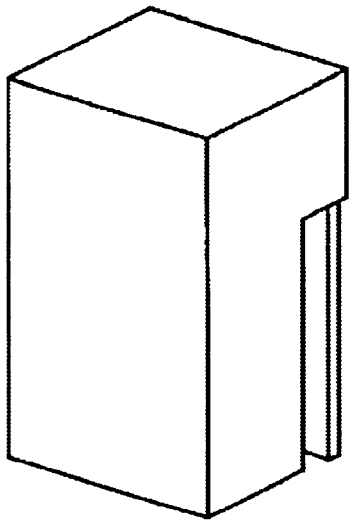
FIG. 6 is a first perspective view of the protective enclosure depicted in FIGS. 1 through 5.
Figure 8:
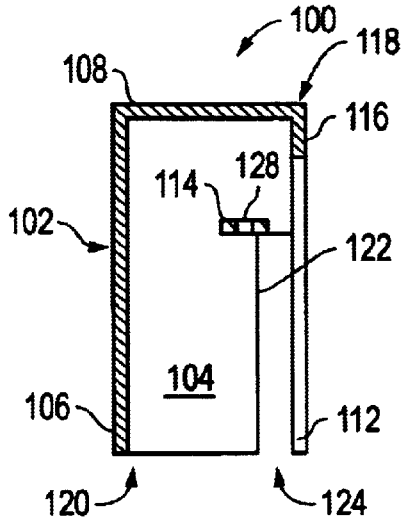
FIG. 8 is a cross-sectional view taken along the line 8—8 in FIG. 7.

As depicted in FIGS. 1 through 4, the handle retaining assembly 16 is rotatably mounted on a first door 28, such as via a plurality of mounting saddles 27. In a first dual door arrangement as depicted FIGS. 1 and 2, the elongated door latching member 12 is pivotally mounted on the first door 28. Accordingly, in the first dual door arrangement, the first door 28 and a second door 30 each carry a respective door latching apparatus. In a second dual door arrangement as depicted in FIGS. 3 and 4, the elongated door latching member 12 is rotatably mounted on the second door 30. Accordingly, in the second dual door arrangement, the first door 28 and the second door 30 jointly carry a single door latching apparatus. In a single door arrangement (not shown), the handle retaining assembly 16 and the door latching member 12 are mounted on the same door (i.e. the single door) as depicted in FIGS. 1 and 2.

FIGS. 1 through 9 depict a protective enclosure 100 in accordance with a first embodiment of the disclosures made herein. As depicted in FIGS. 1 through 5, the protective enclosure 100 is capable of being positioned in a mounted position M1 with respect to the handle retaining assembly 16 of the door latching apparatus 16. When in the mounted position M1, the lock 24 is positioned within a hollow body 102 of the protective enclosure 100. The structure (e.g. materials, fabrication technique, etc.) and dimensions (length width and height) of the protective enclosure 100 are configured for limiting the ability for the handle retaining assembly 16 or the shack 26 of the lock 24 to be cut a bolt cutter, saw or other capable device.

It is also advantageous for the dimensions or mounted position of a protective enclosure, such as the protective enclosure 100 and other embodiments of protective enclosures disclosed herein, to limit the potential for the door latching handle 14 to be cut. By cutting the portion of the door latching handle 14 that extends between the handle retaining assembly 16 and the door latching member 12, unauthorized access may be attained through the first door 28 and/or the second door 30. Accordingly, it is contemplated herein that dimensions and mounting orientations of protective enclosures disclosed may be manipulated for effectively concealing various portions of the door latching handle 14.

In the embodiment depicted in FIGS. 1 through 9, the hollow body 102 includes spaced apart side walls 104, a front wall 106, a top wall 108, a first handle-engaging member 110, a second handle-engaging 112 and a lock-capturing member 114. The front wall 106 is attached between the spaced apart side walls 104. The first and the second handle-engaging members 110, 112 at least partially defining a rear wall 116 of the hollow body 102. The first and the second handle-engaging member 110, 112 extend from a top end 118 of the hollow body 102 toward a bottom end 120 of the hollow body 102. The first and the second handle-engaging member 110, 112 lay in a common plane and are offset from a rear edge 122 of each one of the side walls 104.

A handle-receiving channel 124, FIGS. 6 through 9, is defined between the side walls 104 and the first and the second handle-engaging member 110,112. The first handle-engaging member 110 is spaced apart from the second handle-engaging member 112, thereby defining a recess 126 therebetween for receiving a handle retaining assembly 16 of a door latching apparatus therein. A centerline CL2 of the recess 126 is essentially centered on a centerline CL3 of the hollow body 102. The centerline CL3 of the hollow body 102 is defined between the spaced apart side walls 104 of the hollow body 102.

Referring to FIGS. 1 through 5, the first handle-engaging member 110 and the second handle receiving member 112 are positioned between the door latching handle 14 and the first door 28 when the door latching handle 14 is in the door latching position LP1 and the protective enclosure is in the mounted position Ml with respect to the handle retaining assembly 16. When the protective enclosure 100 is in the mounted position M1, the orientation of the first and the second handle-engaging members 110, 112 advantageously limit the ability for a pry-bar or similar tool to be inserted behind the door latching handle 14 at a position that promotes defeating of the handle retaining assembly 16. With sufficient leverage and intent, it is contemplated that the door retaining assembly 16 is capable of being pulled loose from the first door 18.

As depicted in FIGS. 6 through 9, the handle-receiving channel is truncated between the top end 118 and the bottom end 120 of the hollow enclosure 102. In this manner, access to the handle retaining assembly 16 and to the lock 24 through the handle-receiving channel 124 is reduced. Similarly, the rear edge 112 of each one of the sidewalls 104 is positioned at a sufficient depth to received the door latching handle 14, but to minimize the width of the handle receiving channel 124. Accordingly, the potential for the handle retaining member 16 and the lock 24 to be tampered with through the handle-receiving channel 124 is reduced.

It is contemplated herein that a hollow body according to other embodiments of the disclosures herein may have a handle-receiving channel that extends from a top wall of the hollow body to a bottom end of the hollow body. In such embodiments, side walls of the hollow body are completely detached from a rear wall, a first handle engaging member and a second handle engaging member of the hollow body.

Referring to FIGS. 1 through 9, the lock-capturing member 114 is attached to the hollow body and includes a shank-receiving aperture 128 therein for receiving the shank 26 of the lock 24. The shank-receiving aperture 128 is positioned within the hollow body 102. The shank-receiving aperture 128 of the lock-capturing member 114 is essentially centered on the centerline CL3 of the hollow body 102. Accordingly, the shank-receiving aperture 128 of the lock-capturing member 114 is essentially aligned with the shank-receiving aperture 22 of the stationary flange 18 when the protective enclosure 100 is in the mounted position M1 with respect to the handle retaining assembly 16.

Figure 7:
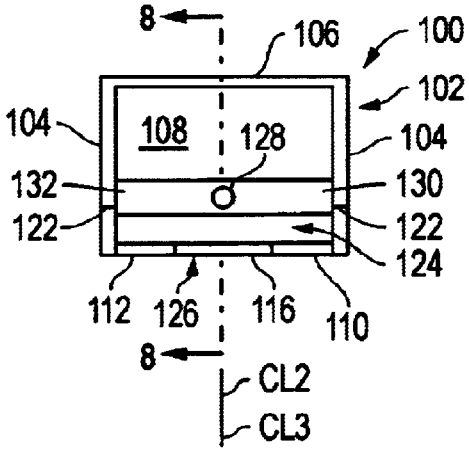
FIG. 7 is a bottom view of the protective enclosure depicted in FIGS. 1 through 5.
Figure 9:
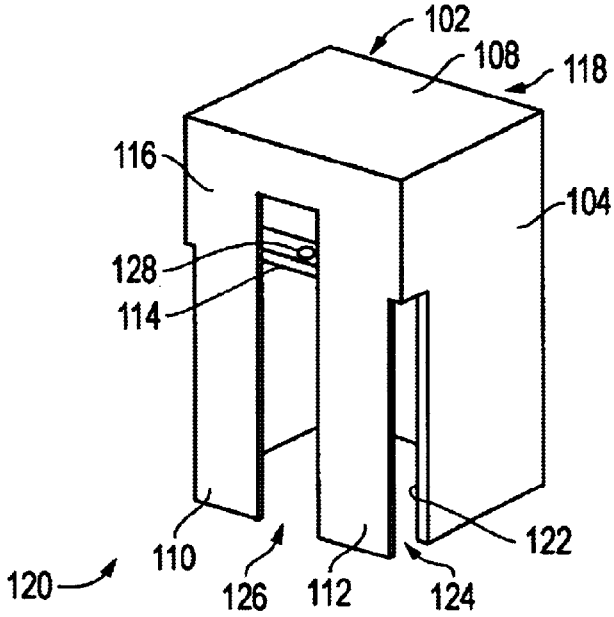
FIG. 9 is a second perspective view of the protective enclosure depicted in FIGS. 1 through 5.
Figure 10:
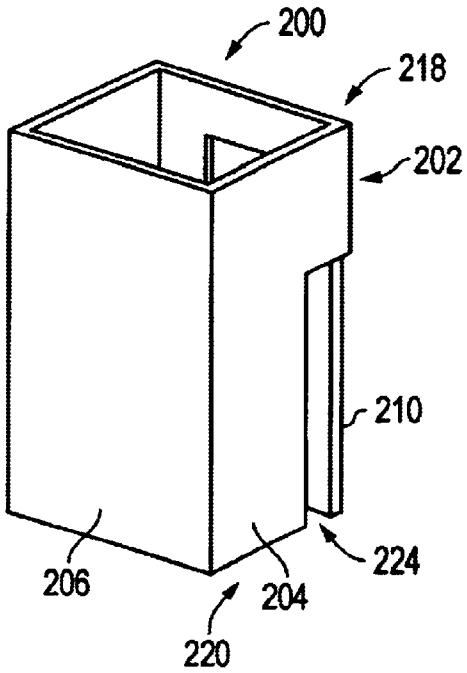
FIG. 10 is a first perspective view depicting a protective enclosure in accordance with a second embodiment of the disclosures made herein
Figure 12:
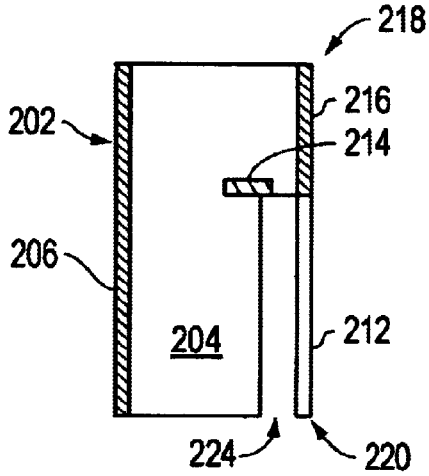
FIG. 12 is a cross-sectional view taken along the line 12—12 in FIG. 11.

As depicted in FIG. 7, the lock-capturing member 114 is attached to and extends between the spaced apart side walls 104 of the hollow body 102. The lock-capturing member 114, as depicted in FIG. 7, is an elongated bar having a first end 130 attached to a first one of the spaced apart side walls 104 and a second end 132 attached to a second one of the spaced apart side walls 104. It is contemplated herein that in other embodiments of the lock-capturing member 114, the lock capturing member 114 has a configuration different than an elongated bar. For example, the lock-capturing member 114 could be configured as a tongue that is attached to the front wall 106 and extends toward the rear wall 116.

FIGS. 10 through 13 depict a protective enclosure 200 in accordance with a second embodiment of the disclosures made herein. The protective enclosure 200 is capable of being mounted in the door latching apparatus depicted in FIGS. 1 through 5 in a similar manner as the protective enclosure 100. The protective enclosure 200 includes a number of structural difference, as disclosed below, relative to the protective enclosure 100.

The protective enclosure 200 does not include a top wall as does the protective enclosure 100 disclosed above. Accordingly, the protective enclosure 200 includes a hollow body 202 having a rear wall 216 that is attached between spaced apart side walls 204 of the hollow body 202. The protective enclosure 200 includes a first handle engaging member 210, a second handle engaging member 212 and a lock-capturing member 214. The lock-capturing member 214 is attached to and extends between the side walls 204 of the hollow body 202.

The first handle engaging member 210 and the second handle engaging member 212 are attached to the rear wall 216 and extend from a top end 218 of the hollow body 202 toward a bottom end 220 of the hollow body 202. A handle-receiving channel 224 is defined between the side walls 204 and the first and the second handle-engaging member 210,212. The first handle-engaging member 210 is spaced apart from the second handle-engaging member 212, thereby defining a recess 226 therebetween for receiving a handle retaining assembly, such as the handle receiving assembly 16 depicted in FIGS. 1 through 5.

Figure 11:
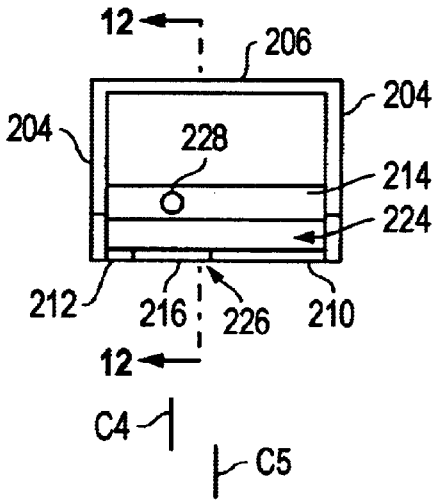
FIG. 11 is a bottom view of the protective enclosure depicted in FIG. 10.
Figure 13:
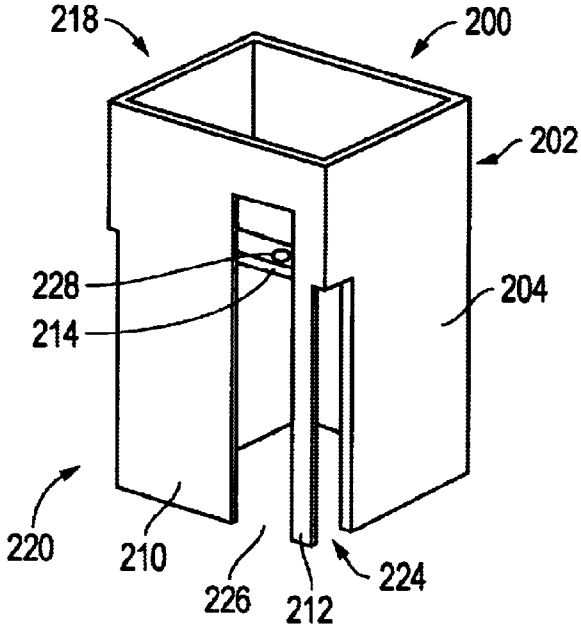
FIG. 13 is a second perspective view of the protective enclosure depicted in FIG. 10.

A centerline C4 the recess 226 is substantially offset from a centerline CL5 of the hollow body 202, as depicted in FIG. 11. The centerline CL5 of the hollow body 202 is defined between the spaced apart side walls 204 of the hollow body 202. The lock-capturing member 214 includes a shank-receiving aperture 228 that is essentially aligned with the centerline of the C4 of the recess 226.

The offset orientation of the recess 226 and the shank receiving aperture 228 result in the protective enclosure 200 being mounted in an off-set manner with respect to a handle retaining assembly. Accordingly, additional space is provided within the hollow body 202 on a first side of shank-receiving aperture 228 than to a second of the shank-receiving aperture 228. Such additional space facilitates easier installation of a lock on the handle retaining assembly within the hollow body 202. Furthermore, by mounting the protective enclosure 200 in an off-set manner with respect to a handle retaining assembly, various portions of a door latching handle may be better concealed to limit the potential for cutting the door latching handle for gaining unauthorized access through a secured door or doors.

It is contemplated herein that a protective enclosure according to another embodiment of the disclosures herein (not shown) includes a shielding member such as a plate attached to an appropriate side wall of such protective enclosure. Accordingly, such a shielding member limits the potential for cutting the door latching handle for gaining unauthorized access through a secured door or doors.

Figure 14:
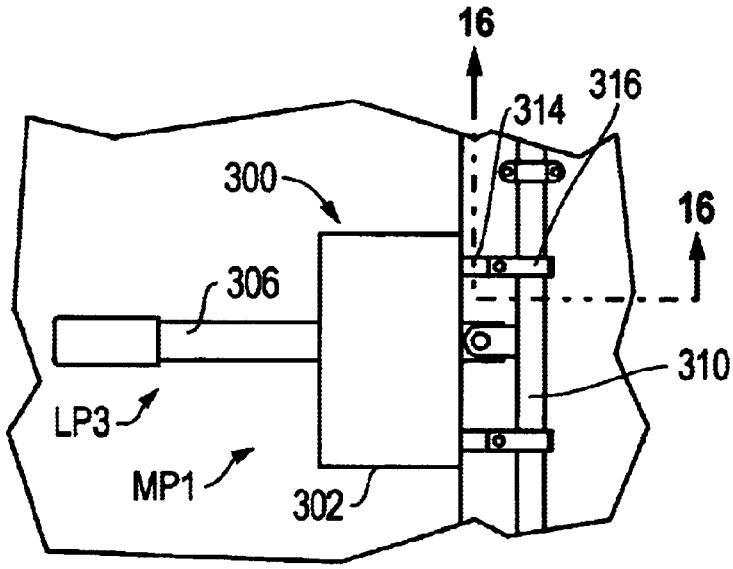
FIG. 14 is a front view depicting a door latching apparatus in accordance with a third embodiment of the disclosures made herein, wherein the door latching apparatus has a protective enclosure attached thereto in a mounted position.
Figure 15:
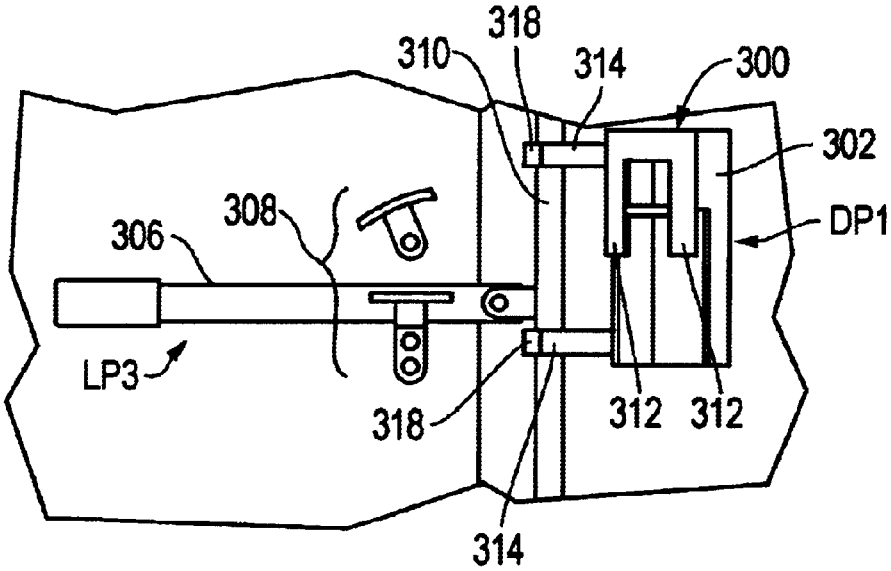
FIG. 15 is a front view of the door latching apparatus depicted in FIG. 14, wherein the protective enclosure is in dismounted position.
Figure 16:
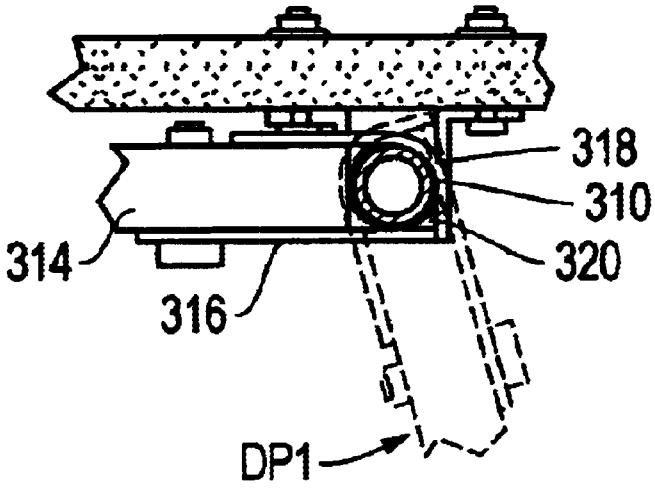
FIG. 16 is a cross-sectional view taken along the line 16—16 in FIG. 14.
Figure 17:
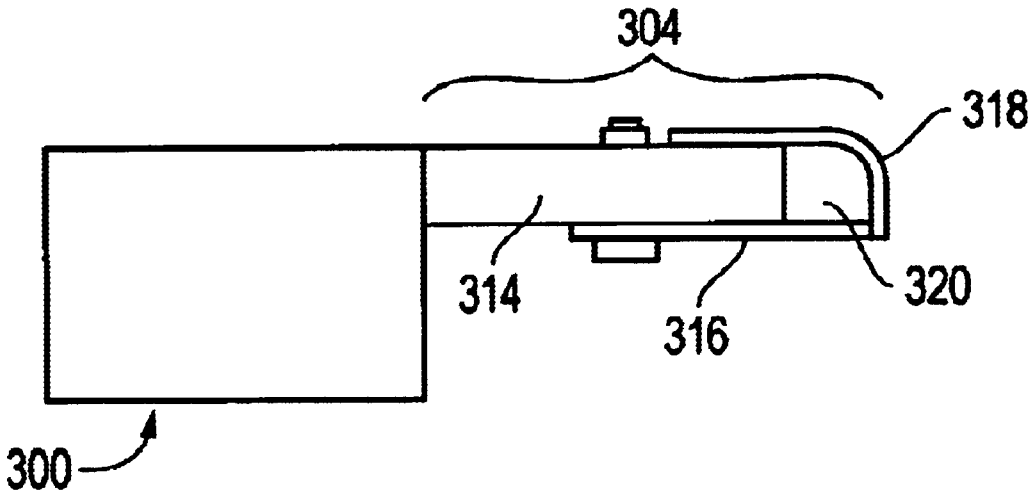
FIG. 17 is a top view of the protective enclosure depicted in FIG. 14.

FIGS. 14 through 16 depict a door latching apparatus in accordance with a third embodiment of the disclosures made herein. The door latching apparatus illustrated in FIGS. 14 through 16 is operable in a similar manner as the door latching apparatus disclosed in FIGS. 1 through 5 for latching a door or doors in a closed position and for unlatching the door or doors from the closed position. Accordingly, the operation of the door latching assembly disclosed in FIGS. 14 through 16 will not be discussed further.

The door latching apparatus disclosed in FIGS. 14 through 16 includes a protective enclosure 300 mounted thereon. As depicted in FIGS. 14 through 17, the protective enclosure 300 includes a hollow body 302 and two body mounting assemblies 304 attached to the hollow body 302. The body mounting assemblies 304 are capable of enabling the hollow body 302 to be moved between a mounted position MP1, FIG. 14, and a dismounted position DP1, FIG. 15, with respect to a handle retaining assembly of a door. When the hollow body 302 is in the mounted position MP1 and a door latching handle 306 of the door latching apparatus is in a door latching position LP3, a lock is capable of being mounted on the protective enclosure 300 and on a handle retaining assembly 308, FIG. 16, for locking the door latching handle 306 in the door latching position LP3. A detailed description of the manner in which a lock is mounted jointly on a protective enclosure as disclosed herein and on a handle retaining assembly is provided above in reference to FIGS. 1 through 9.

Moving the hollow body 302 between the mounted position MP1 and the dismounted position DP1 is facilitated by axially displacing the hollow body 302 along a longitudinal axis L1 and by pivoting the hollow body 302 about the longitudinal axis L1 of an elongated door latching member 310. Axially displacing the hollow body 302 along the longitudinal axis L1 of the elongated door latching member 310 facilitates engaging and disengaging one or more handle engaging members 312 of the hollow body 302 from the door latching handle 306. When engaged with the door latching handle 306, the one or more door latching members 312 are positioned between the door latching handle 306 and a door 314 to which the handle retaining member 308 is attached. Omission of the one or more handle engaging members 312 eliminates the requirement for the hollow body 302 to be capable of being axially displaced along the longitudinal axis L1 of the elongated door latching member 310.

Referring to FIGS. 14 through 17, each one of the body mounting assemblies 304 includes an arm 314 and an arm retaining member 316. Each arm 314 is capable of being pivotally and slideably mounted on the elongated door latching member 310. Each one of the arms 314 is attached at a respective first end to the hollow body 302 and includes a mounting bracket 318 at a respective second end. Each mounting bracket 318 and attached arm retaining member 316 jointly define a respective pocket 320, FIGS. 16 and 17, capable of receiving the elongated door latching member 310. Each arm retaining member 316 is attachable to corresponding one of the arms 314 for securing the elongated door latching member 310 in the respective pocket 320.

Figure 18:
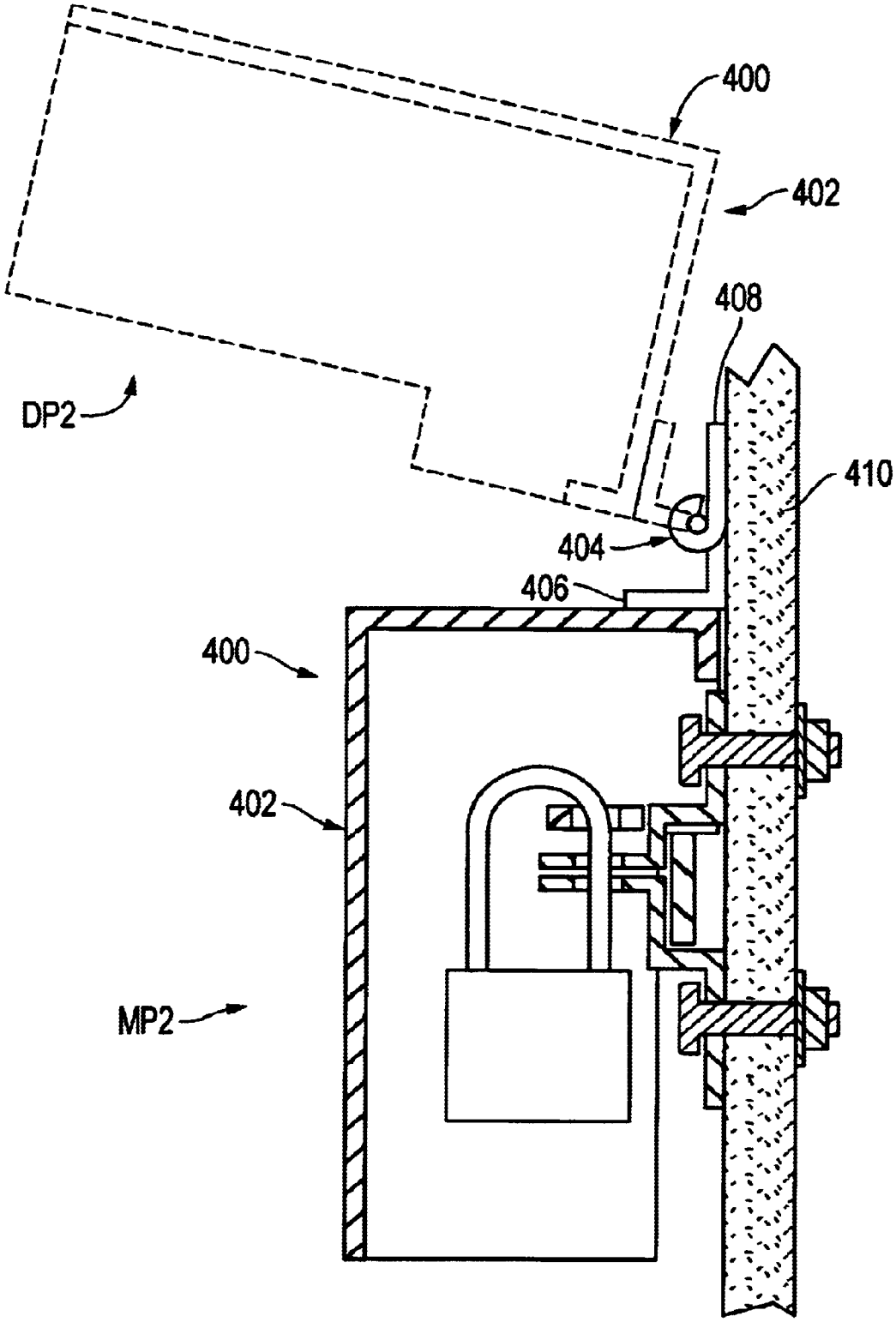
FIG. 18 is a cross-sectional side view depicting a protective enclosure in accordance with a fourth embodiment of the disclosures made herein, wherein the door latching apparatus has a hinge attached thereto for enabling the protective enclosure to be moved between a mounted position and a dismounted position with respect to an attached door.

FIG. 18 depicts a protective enclosure 400 in accordance with a fourth embodiment of the disclosures made herein. The protective enclosure 400 includes a hollow body 402 having essentially the same construction as the hollow body 102 disclosed in reference to FIGS. 1 through 9, with the exception that hollow body 402 does not include any handle engaging members. The protective enclosure 400 includes a hinge 404 attached to the hollow body 402. The hinge 404 includes a first hinge member 406 pivotally attached to a second hinge member 408. The first hinge member 406 is attached to the hollow body 402 and the second hinge member 408 capable of being attached to a door 410. The hinge 404 permits the hollow body to be moved between a mounted position MP2 and a dismounted position DP2 with respect to a handle retaining assembly 412 that is mounted on the door 410.

Figure 19:
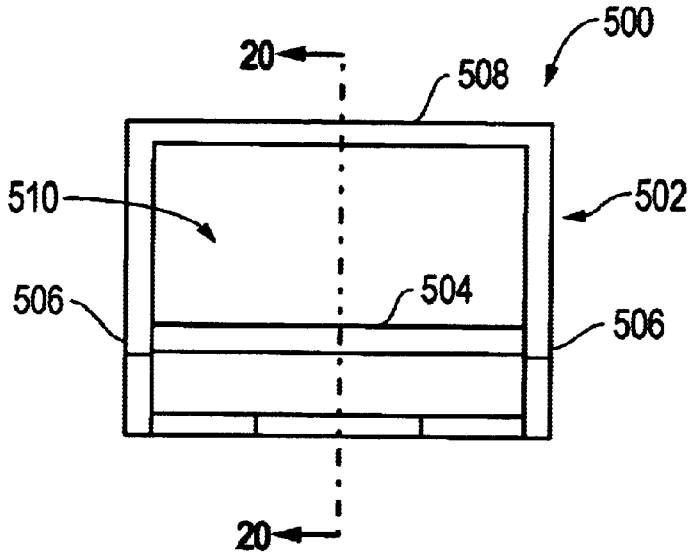
FIG. 19 is a bottom view depicting a protective enclosure in accordance with a fifth embodiment of the disclosures made herein, wherein a lock capturing member of the protective enclosure omits a shank-receiving aperture.
Figure 20:
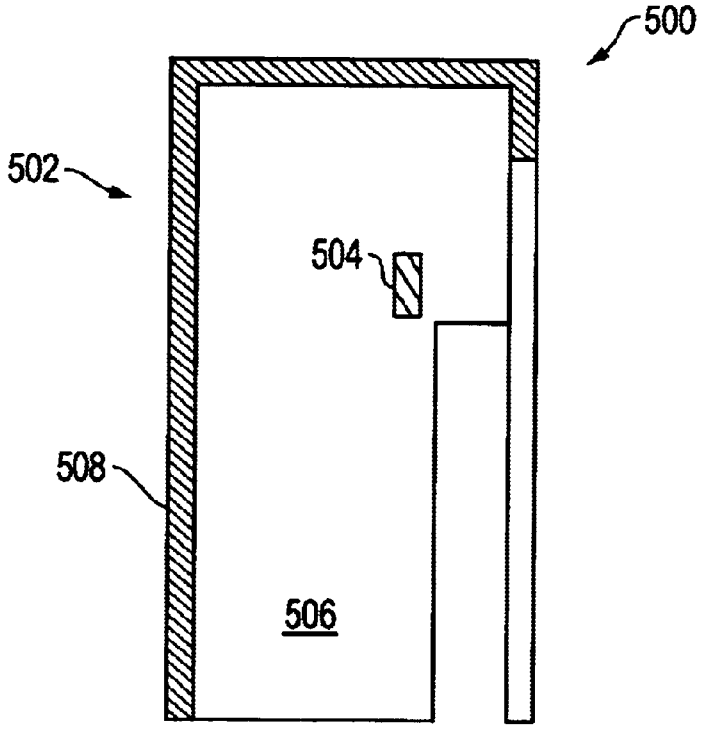
FIG. 20 is a cross-sectional view taken along the line 20—20 in FIG. 19.

FIGS. 19 and 20 depicts a protective enclosure 500 in accordance with a fifth embodiment of the disclosures made herein. The protective enclosure 500 includes a hollow body 502 having essentially the same construction as the hollow body 102 disclosed in reference to FIGS. 1 through 9. However, a lock-capturing member 504 of the protective enclosure 500 does not include a shank-receiving aperture as does the lock-capturing member 114 of the protective enclosure 100. Rather, side walls 506 and a front wall 508 of the hollow body 502 in combination with the lock-capturing member 504 define a shank-receiving aperture 510 positioned within the hollow body 502 for receiving a shank of a lock therethrough. The aperture is effectively an opening defined between the lock-capturing member 504, the side walls 506 and the front wall 508.

Embodiments of the protective enclosure disclosed herein may be made from commercially available materials and fabricated using known processes. Examples of commercially available materials include steel plate, sheet, tube and pipe materials. Examples of known processes include cutting, welded, punching, blanking, turning, drilling, tapping, milling, CNC machining, laser cutting, water jet cutting, plating, powder coating and the like.

A protective enclosure according to one embodiment of the disclosures herein includes a hollow body and a lock capturing member attached tot he hollow body. The hollow body includes spaced apart side walls, a front wall attached between the spaced apart side walls and a first handle-engaging member at least partially defining a rear wall. The first handle-engaging member extends from a top end of the hollow body toward a bottom end of the hollow body. The first handle-engaging member is offset from a rear edge of each one of the side walls wherein a handle-receiving channel is defined between the side walls and the first handle-engaging member. The lock-capturing member is attached to the hollow body and includes a shank-receiving aperture for receiving a shank of a lock therethrough. The shank-receiving aperture is positioned within the hollow body.

A protective enclosure according to another embodiment of the disclosures herein includes a hollow body, a lock-capturing member attached to the hollow body and a hinge attached to the hollow body. The hollow body includes spaced apart side walls and a front wall. The lock-capturing member includes a shank-receiving aperture for receiving a shank of a lock therethrough. The shank-receiving aperture is positioned within the hollow body. The hinge has a first hinge member pivotally attached to a second hinge member. The first hinge member is attached to the hollow body and the second hinge member is capable of being attached to a door. Accordingly, the hollow body is capable of being moved between a mounted position and a dismounted position with respect to a handle retaining assembly of the door.

A protective enclosure according to another embodiment of the disclosures herein includes an elongated door latching member, a door latching handle, a handle retaining assembly and a protective enclosure. The elongated door latching member is capable of being pivotally attached to a first door for being moved between a latched position and an unlatched position. The door latching handle is attached to the elongated door latching member for moving the elongated door latching member between the latched position and the unlatched position. The handle retaining assembly is capable of being attached to a second door, of retaining the door latching handle in a door latching position and of having a shank of a lock extending therethrough for locking the door latching handle in the latching position. The protective enclosure is movably attached to the elongated door latching member for being moved between a mounted position and a dismounted position with respect to the handle retaining assembly.

A protective enclosure according to another embodiment of the disclosures herein includes a hollow body and a lock-capturing member attached to the hollow body. The hollow body includes spaced apart side walls, a front wall attached between the spaced apart side walls and a first handle-engaging member at least partially defining a rear wall. The first handle-engaging member extends from a top end of the hollow body toward a bottom end of the hollow body. The first handle-engaging member is offset from a rear edge of each one of the side walls wherein a handle-receiving channel is defined between the side walls and the first handle-engaging member. The lock-capturing member is attached at a first end thereof to a first one of the walls of the hollow body and at a second end thereof to a second one of the walls of the hollow body. The lock-capturing member, the front wall and the side walls define an aperture for receiving a shank of a lock therethrough.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. To avoid unnecessary detail, the description omits certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A protective enclosure, comprising:

a one-piece hollow body including spaced apart side walls, a front wall attached between said spaced apart side walls and a rear wall attached between said spaced apart side walls, the rear wall extending from adjacent to a first end of the one-piece hollow body toward a second end of the one-piece hollow body;

spaced apart handle-engaging members attached to the rear wall and extending toward the second end of the one-piece hollow body wherein a recess capable of receiving a handle retaining assembly therein is defined between said spaced apart handle engaging members, each one of said spaced apart handle-engaging members being offset from a rear edge of a respective one of said side walls wherein a handle-receiving channel is defined between each one of said spaced apart handle-engaging members and the respective one of said spaced apart side walls; and a lock-capturing member attached to the hollow body and including a first shank-receiving aperture extending therethrough, wherein the shank-receiving aperture is positioned within the hollow body and wherein the lock-capturing member and the front wall at least partially define a second shank receiving aperture.

2. The protective enclosure of claim 1 wherein the one-piece hollow body further includes a top wall attached to at least one of said spaced apart side walls, the front wall and the rear wall.

3. The protective enclosure of claim 1 wherein the lock-capturing member is attached to and extends between said spaced apart side walls of the hollow body.

4. The protective enclosure of claim 1 wherein the lock-capturing member is an elongated bar having a first end thereof attached to a first one of said spaced apart side walls and a second end thereof attached to a second one of said spaced apart side walls.

5. The protective enclosure of claim 1 wherein the shank-receiving aperture of the lock-capturing member is essentially centered between said spaced apart side walls of the hollow body.

6. The protective enclosure of claim 1 wherein the shank-receiving aperture of the lock-capturing member is substantially offset from a centerline defined by said spaced apart side walls of the hollow body.

7. The protective enclosure of claim 1, further comprising:

a body mounting assembly attached to the hollow body and capable of enabling the hollow body to be pivoted about a longitudinal axis of an elongated door latching member between a mounted position and a dismounted position with respect to a handle retaining assembly of a door and to be axially displaced along the longitudinal axis of the elongated door latching member.

8. The protective enclosure of claim 7 wherein the body mounting assembly includes an arm capable of being pivotally and slideably mounted on the elongated door latching member and an arm retaining member attachable to the arm for securing the arm to the elongated door latching member.

9. The protective enclosure of claim 8 wherein:

the arm is attached at a first end thereof to the hollow body and includes a mounting bracket at a second end thereof, the mounting bracket at least partially defining a pocket for receiving the elongated door latching member therein; and the arm retaining member is attachable to the arm for securing the elongated door latching member in the pocket.

10. A protective enclosure, comprising:

a hollow body including spaced apart side walls and a front wall attached between said spaced apart side walls;

a lock-capturing member attached to the hollow body and including a shank-receiving aperture extending therethrough for receiving a shank of a lock, the shank-receiving aperture positioned within the hollow body; and a body mounting assembly attached to the hollow body and capable of enabling the hollow body to be pivoted about a longitudinal axis of an elongated door latching member between a mounted position and a dismounted position with respect to a handle retaining assembly of a door and to be axially displaced along the longitudinal axis of the elongated door latching.

11. The protective enclosure of claim 10 wherein the body mounting assembly includes an arm capable of being pivotally and slideably mounted on the elongated door latching member and an arm retaining member attachable to the arm for securing the arm to the elongated door latching member.

12. The protective enclosure of claim 11 wherein:

the arm is attached at a first end thereof to the hollow body and includes a mounting bracket at a second end thereof, the mounting bracket at least partially defining a pocket for receiving the elongated door latching member therein; and the arm retaining member is attachable to the arm for securing the elongated door latching member in the pocket.

13. A door latching apparatus, comprising:

an elongated door latching member capable of being pivotally attached to a first door for being moved between a latched position and an unlatched position;

a door latching handle attached to the elongated door latching member for moving the elongated door latching member between the latched position and the unlatched position;

a handle retaining assembly capable of being attached to a second door, of retaining the door latching handle in a door latching position and of having a shank of a lock extending therethrough for locking the door latching handle in the latching position; and a protective enclosure movably attached to the elongated door latching member for being moved between a mounted position and a dismounted position with respect to the handle retaining assembly, the protective enclosure including:

a one-piece hollow body including spaced apart side walls, a front wall attached between said spaced apart side walls and a rear wall attached between said spaced apart side walls, the rear wall extending from adjacent to a first end of the one-piece hollow body toward a second end of the one-piece hollow body;

spaced apart handle-engaging members attached to the rear wall and extending toward the second end of the one-piece hollow body wherein a recess capable of receiving a handle retaining assembly therein is defined between said spaced apart handle engaging members, each one of said spaced apart handle-engaging members being offset from a rear edge of a respective one of said side walls wherein a handle-receiving channel is defined between each one of said spaced apart handle-engaging members and the respective one of said spaced apart side walls; and a lock-capturing member attached to the hollow body and including a first shank-receiving aperture extending therethrough, wherein the shank-receiving aperture is positioned within the hollow body and wherein the lock-capturing member and the front wall at least partially define a second shank receiving aperture.

14. The door latching apparatus of claim 13 wherein the first handle-engaging member is positioned between the handle and the second door when the door latching handle is in the door latching position and the protective enclosure is in the mounted position with respect to the handle retaining assembly.

15. The door latching apparatus of claim 13 wherein the lock-capturing member is an elongated bar having a first end thereof attached to a first one of said spaced apart side walls and a second end thereof attached to a second one of said spaced apart side walls.

16. The door latching apparatus of claim 13 wherein:

the shank-receiving aperture of the lock-capturing member is essentially centered between said spaced apart side walls of the hollow body;

the handle retaining assembly further includes a stationary flange and a movable flange, the stationary flange and the movable flange each include a shank-receiving aperture therein, the shank receiving aperture of the stationary flange being essentially aligned with the shank-receiving aperture of the movable flange when the movable flange is in a handle retaining position; and the shank-receiving aperture of the lock-capturing member is essentially aligned with the shank-receiving aperture of the stationary flange when the protective enclosure is in the mounted position.

17. The door latching apparatus of claim 13 wherein:

the shank-receiving aperture is substantially offset from a centerline defined by said spaced apart side walls of the hollow body;

the handle retaining assembly further includes a stationary flange and a movable flange, the stationary flange and the movable flange each include a shank-receiving aperture therein, the shank receiving aperture of the stationary flange being essentially aligned with the shank-receiving aperture of the movable flange when the movable flange is in a handle retaining position; and the shank-receiving aperture of the lock-capturing member is essentially aligned with the shank-receiving aperture of the stationary flange when the protective enclosure is in the mounted position.

18. The door latching apparatus of claim 13 wherein the protective enclosure further includes:

a body mounting assembly attached to the hollow body for enabling the protective enclosure to move between the mounted position and the dismounted position with respect to the handle retaining assembly.

19. The door latching apparatus of claim 18 wherein the body mounting assembly includes an arm capable of being pivotally and slideably mounted on the elongated door latching member and an arm retaining member capable of being attached to the arm for securing retaining the arm to the elongated door latching member.

20. The door latching apparatus of claim 19 wherein:

the arm is attached to the hollow body at a first end thereof and includes a mounting bracket at a second end thereof, the mounting bracket at least partially defining a pocket for receiving the elongated door latching member therein; and the arm retaining member is capable of being attached to the arm for retaining the elongated door latching member in the pocket.

21. The door latching apparatus of claim 13 wherein the one-piece hollow body further includes a top wall attached to at least one of said spaced apart side walls, the front wall and the rear wall.

22. A door latching apparatus, comprising:

an elongated door latching member capable of being pivotally attached to a door for being moved between a latched position and an unlatched position;

a door latching handle attached to the elongated door latching member for moving the elongated door latching member between the latched position and the unlatched position;

a handle retaining assembly capable of being attached to the door, of retaining the door latching handle in a door latching position and of having a shank of a lock extending therethrough for locking the door latching handle in the latching position; and a protective enclosure movably attached to the elongated door latching member for being moved between a mounted position and a dismounted position with respect to the handle retaining assembly, the protective enclosure including:

a one-piece hollow body including spaced apart side walls, a front wall attached between said spaced apart side walls and a rear wall attached between said spaced apart side walls, the rear wall extending from adjacent to a first end of the one-piece hollow body toward a second end of the one-piece hollow body;

spaced apart handle-engaging members attached to the rear wall and extending toward the second end of the one-piece hollow body wherein a recess capable of receiving a handle retaining assembly therein is defined between said spaced apart handle engaging members, each one of said spaced apart handle-engaging members being offset from a rear edge of a respective one of said side walls wherein a handle-receiving channel is defined between each one of said spaced apart handle-engaging members and the respective one of said spaced apart side walls; and a lock-capturing member attached to the hollow body and including a first shank-receiving aperture extending therethrough, wherein the shank-receiving aperture is positioned within the hollow body and wherein the lock-capturing member and the front wall at least partially define a second shank receiving aperture.

23. A protective enclosure, comprising:

a one-piece hollow body including spaced apart side walls, a front wall attached between said spaced apart side walls and a rear wall attached between said spaced apart side walls, the rear wall extending from adjacent to a first end of the one-piece hollow body toward a second end of the one-piece hollow body;

spaced apart handle-engaging members attached to the rear wall and extending toward the second end of the one-piece hollow body wherein a recess capable of receiving a handle retaining assembly therein is defined between said spaced apart handle engaging members, each one of said spaced apart handle-engaging members being offset from a rear edge of a respective one of said side walls wherein a handle-receiving channel is defined between each one of said spaced apart handle-engaging members and the respective one of said spaced apart side walls; and a lock-capturing member attached to the hollow body, the lock-capturing member attached at a first end thereof to a first one of said side walls of the hollow body and at a second end thereof to a second one of said side walls of the hollow body, wherein the lock-capturing member and the front wall at least partially define a first shank-receiving aperture and wherein the lock-capturing member is offset from a plane defined by the rear wall whereby the lock-capturing member and the rear wall at least partially define a second shank-receiving aperture.

* * * * *